US006032327A

United States Patent [19]

Oka et al.

[11] Patent Number: 6,032,327

[45] Date of Patent: Mar. 7, 2000

[54] ELECTRIC VACUUM CLEANER

[75] Inventors: Yasuhiro Oka, Osaka; Katsuhiko Umeda, Nabari, both of Japan

[73] Assignee: Sharp Kabushiki Kaisha, Osaka, Japan

[21] Appl. No.: 09/184,879

[22] Filed: Nov. 3, 1998

[30] Foreign Application Priority Data

Jan. 27, 1998 [JP] Japan ..... 10-013667
Jun. 8, 1998 [JP] Japan ..... 10-158910

[51] Int. Cl.[7] ..... A47L 5/14

[52] U.S. Cl. ..... 15/346; 15/375; 15/387

[58] Field of Search ..... 15/346, 375, 376, 15/387

[56] References Cited

U.S. PATENT DOCUMENTS

| | | | |
|---|---|---|---|
| 1,323,925 | 12/1919 | Stewart | 15/387 X |
| 1,718,293 | 6/1929 | Hoover | 15/376 X |
| 2,085,700 | 6/1937 | Kitto | 15/375 |
| 2,331,692 | 10/1943 | Hunt | 15/387 |
| 2,993,224 | 7/1961 | Child | 15/387 |
| 3,694,848 | 10/1972 | Alcala | 15/346 |
| 3,704,482 | 12/1972 | Brannon | 15/387 X |
| 3,872,533 | 3/1975 | Proffit | 15/387 X |
| 4,594,749 | 6/1986 | Waterman | 15/15 |
| 5,168,559 | 12/1992 | Williams | 15/346 |
| 5,647,092 | 7/1997 | Miwa . | |

FOREIGN PATENT DOCUMENTS

| | | |
|---|---|---|
| 7136082 | 5/1995 | Japan . |
| 2251178A | 7/1992 | United Kingdom . |
| 2277677A | 11/1994 | United Kingdom . |

*Primary Examiner*—Chris K. Moore

[57] ABSTRACT

A rotating brush including a hollow cylindrical rotor having through holes in its peripheral wall and bristles on its peripheral surface is provided in a nozzle of an upright electric vacuum cleaner. A reflux passage connecting a fan chamber in the cleaner body and an end of the rotor is provided so that a slip stream of an electric fan for producing a suction stream jets out into the nozzle from the rotor through the holes. A fan for sucking air outside the nozzle is provided at the other end of the rotor so that the sucked air also jets out into the nozzle through the holes. In another electric vacuum cleaner, the rotor of the rotating brush is not provided with through holes but the slip stream of the electric fan is caused to blow the peripheral surface of the rotating brush from its end.

15 Claims, 18 Drawing Sheets

ELECTRIC VACUUM CLEANER

BACKGROUND OF THE INVENTION

1. Field of the Invention

The present invention relates to an electric vacuum cleaner including a nozzle fitted with a rotating brush for promoting the separation of dust from the surface being cleaned.

2. Description of the Prior Art

An electric vacuum cleaner is known which is provided with a rotating brush in a nozzle for sucking dust together with air so that separation of dust from the surface being cleaned is promoted by rubbing the surface by the rotating brush. Japanese Laid-Open Patent Application No. H7-136082 discloses an electric vacuum cleaner which promotes the separation of dust from the surface being cleaned by directing thereto the slip stream from an electric fan for producing a flow of sucked air. The structure of this cleaner is shown in FIGS. 17 to 19 of the drawings accompanying this specification.

FIG. 17 is a sectional side view of the whole cleaner and FIG. 18 is a sectional top plan view of a nozzle. This cleaner is of upright type with the nozzle 71 being arranged at the bottom of a cleaner body 72. A dust bag 74 is fitted downstream from an electric fan 73. The body 72 includes a cover 75, in which the electric fan 73 and the dust bag 74 are housed. The cover 75 includes a lid 76 for putting the dust bag 74 into the body 72 and taking it out of the body. The body 72 also includes a handle 77 for moving the cleaner. The cover 75 has an air outlet 84 for discharging the slip stream from the fan 73 out of the body 72.

The nozzle 71 has a suction port 78 formed in its bottom for sucking dust. The suction port 78 and the dust bag 74 are connected by a suction passage 79. The nozzle 71 also has a blow outlet 80 formed in its bottom and in front of the suction port 78. The blow outlet 80 and the body 72 are connected by a reflux passage 81.

The operation of the electric fan 73 produces a suction flow 82 and a slip stream at the same time. Part 83 of the slip stream is discharged from the cleaner body 72 through the air outlet 84. The other part 85 of the slip stream is directed through the reflux passage 81 and the blow outlet 80 to the surface 90 being cleaned. This blows dust off the surface 90. The blown dust is sucked into the suction port 78 by the suction flow, and flows through the suction passage 79 into the dust bag 74, where it is collected. Air flows from the suction port 78 through the suction passage 79, the bag 74, the reflux passage 81 and the blow outlet 80 in order onto the surface 90, and then returns to the suction port 78. This forms a circulation passage for circulating a flow of sucked air.

FIG. 19 is a sectional side view of another nozzle 86 having a different structure. The nozzle 86 has a blow outlet 87, which is similar to the outlet 80, and a suction port 88 formed in the rear of the outlet 87. The nozzle 86 is fitted with a rotating brush 89 in the suction port 88. The brush 89 can be rotated by the driving force transmitted from an electric motor through a belt. The brush 89 can brush the surface 90 being cleaned. Without the brush 89, the air flow from the outlet 87 might not be able to separate dust from a carpet or the like, to which they are liable to cling or stick. The brush 89 can scratch up or throw up dust to separate them from the surface 90.

According to the above cleaner, because the blow outlet and the suction port are isolated from each other by a wall, air does not flow from the outlet directly to the rotating brush. Therefore, waste threads, hairs, etc. tend to cling to the brush. Moreover, part of the air from the blow outlet is liable to flow out of the nozzle through the gap between the nozzle and the surface. Consequently, the dust blown off the surface being cleaned may spread around the nozzle, and the suction capacity of the cleaner may decrease.

SUMMARY OF THE INVENTION

An object of the present invention is to provide an electric vacuum cleaner which comprises a body having an electric fan and a dust chamber, a nozzle having an opening at its bottom, a suction passage connecting an inside of the nozzle to the dust chamber, and a rotating brush including a rotor having bristles on a peripheral surface thereof and provided in the nozzle so as to rotate around an horizontal axis, and so operates that dust is sucked with air through the opening of the nozzle by an air flow produced by the electric fan through the suction passage, sucked dust is collected in a dust bag housed in the dust chamber, and a surface to be cleaned facing the opening is brushed by the rotating brush so as to promote separation of dust from the surface, wherein dust is prevented from clinging to the rotating brush, dust is prevented from spreading around the cleaner, and high and stable suction capacity is maintained.

To achieve the above object, according to one aspect of the present invention, the rotor is a hollow cylinder having a through hole passing through a peripheral wall thereof, and a reflux passage for guiding a slip stream of the electric fan to an inside of the rotor is provided so that the slip stream of the electric fan blows the surface to be cleaned through the through hole.

In this electric vacuum cleaner, the air in the nozzle flows through the suction passage into the dust chamber, where dust is removed by the dust bag, and further flows through the reflux passage into the rotor of the rotating brush in the nozzle. The air in the rotor jets out through the through hole onto the surface being cleaned, and returns into the nozzle. As a result, air circulates between the nozzle and the cleaner body. The air jetting out through the hole onto the surface flows outward from the rotor. Therefore, the jetting air prevents dust from clinging to the bristles, and blows clinging dust off. Since suction force is developed in the nozzle by the electric fan, the jetting air is sucked again into the suction passage. Consequently, the circulating air does not flow out of the nozzle, and therefore dust does not spread around the nozzle.

To achieve the above object, according to another aspect of the present invention, the rotor is a hollow cylinder having a through hole passing through a peripheral wall thereof, and a suction fan for sucking air from outside the nozzle into the rotor is attached to the rotor so that the sucked air by the sucking fan blows the surface to be cleaned through the through hole.

The suction fan sucks air from the outside of the nozzle into the rotor and the sucked air jets out through the through hole onto the surface being cleaned. The jetting air flows outward from the rotor, preventing dust from clinging to the brush bristles. Since suction force is developed in the nozzle by the electric fan, the air jetting through the hole is sucked into the suction passage without flowing out of the nozzle.

To achieve the above object, according to still another aspect of the present invention, a reflux passage for guiding a slip stream of the electric fan to a vicinity of an end of the rotor is provided, and an air passage for directing the guided slip stream of the electric fan to the peripheral surface of the rotor along the axis is provided at the end of the rotor so that the slip stream of the electric fan blows the surface to be cleaned through the air passage.

In this cleaner, the air in the nozzle flows through the suction passage into the dust chamber, where dust is removed by the dust bag, and returns to the nozzle through the reflux passage. The returning air is directed to the peripheral surface of the rotor and at the same time blows the surface being cleaned. The air directed to the peripheral surface prevents dust from clinging to the bristles, and blows clinging dust off. Since suction force is developed in the nozzle by the electric fan, the jetting air is sucked again into the suction passage. Consequently, the air does not flow out of the nozzle, and therefore dust do not spread around the nozzle. Besides, decrease of the suction force is suppressed.

Specifically, a pulley for receiving a rotation force is attached to the end of the rotor, a through hole is provided in the pulley as the air passage, and a fan is provided in the through hole for sending air to the peripheral surface of the rotor. This fan rotates with the pulley and directs the air from the reflux passage efficiently to the peripheral surface of the rotating brush.

A fan for sending air to the peripheral surface of the rotor may be attached to an end of the rotor opposite the air passage, and an air intake hole may be provided to the nozzle at a position facing the fan. Though it might be difficult for the air from the air passage to reach the end of the rotating brush opposite the air passage, the fan can supply air to the peripheral surface near this end. Besides, by taking outside air in, it is possible to maintain the circulating air abundant and also to prevent the temperature of the cleaner body from rising.

For the electric vacuum cleaners provided with the reflux passage, it is preferable that a removable filter for capturing fine dust is provided in the reflux passage. Even if fine dust leaks out of the dust bag, the filter captures the dust before the slip stream from the electric fan reaches the rotating brush. Therefore, the dust does not enter the nozzle. This prevents dust from sticking to the already cleaned surface. Because the filter can be removed, it very is easy to remove the dust captured by the filter. It is also preferable that a part of the reflux passage between the body and the nozzle comprises a flexible hose, and an end of the hose is attachable to and detachable from the nozzle. When the end is detached from the nozzle, the hose can be used as a blower.

BRIEF DESCRIPTION OF THE DRAWINGS

This and other objects and features of this invention will become clear from the following description, taken in conjunction with the preferred embodiments with reference to the accompanying drawings in which.

DESCRIPTION OF THE PREFERRED EMBODIMENTS

Figure 1:
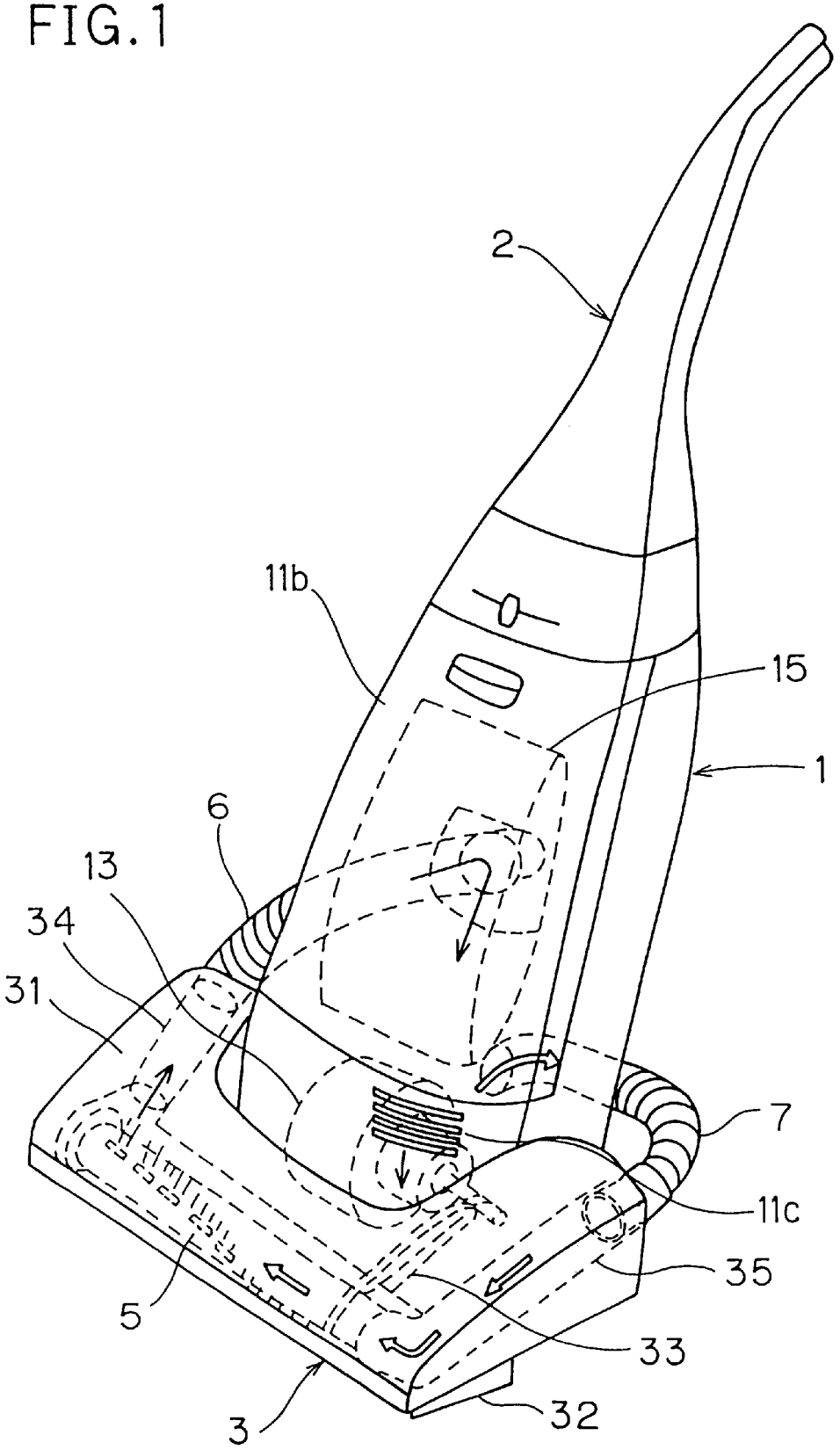
FIG. 1 is a perspective view of an electric vacuum cleaner according to a first embodiment of the invention.
Figure 2:
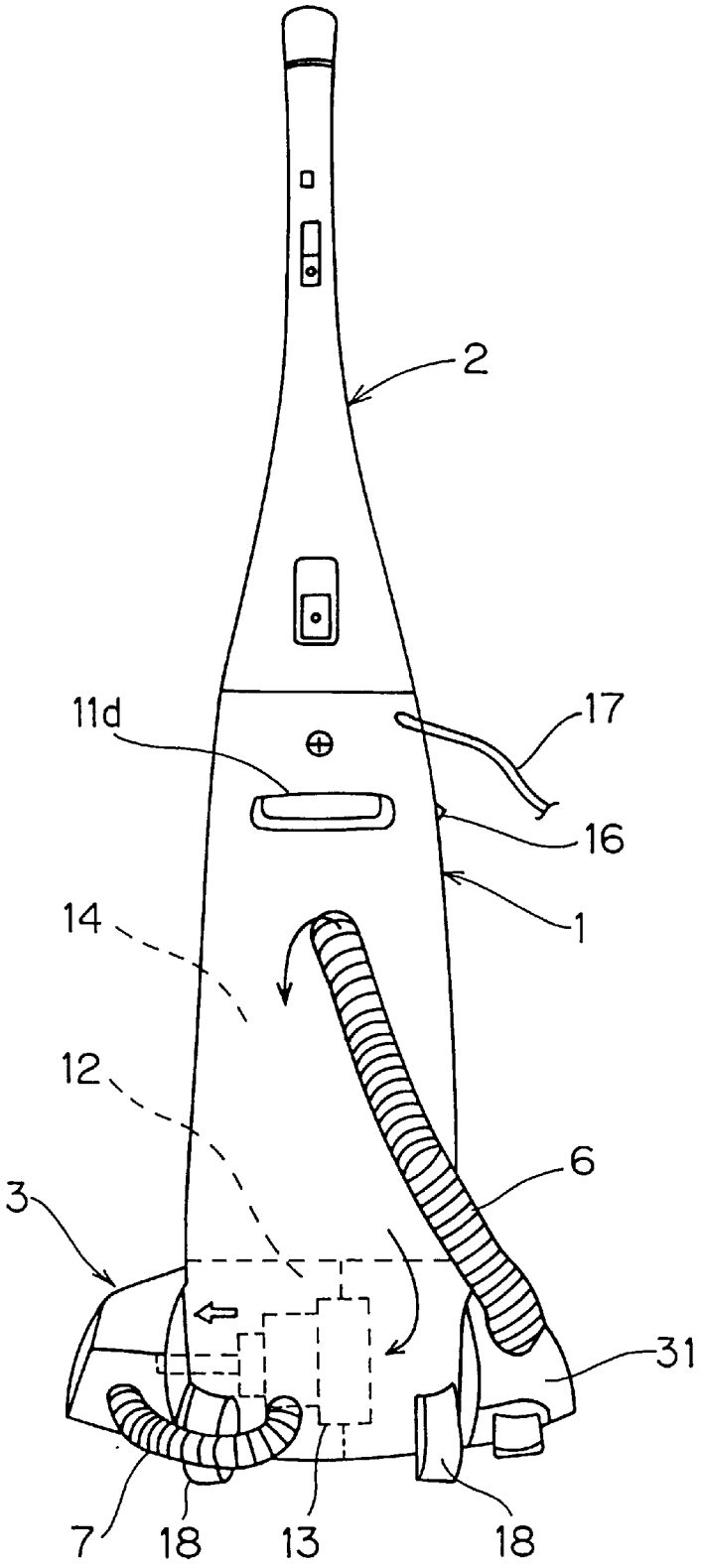
FIG. 2 is a back view of the cleaner according to the first embodiment.

Hereinafter embodiments of the electric vacuum cleaner of the present invention are described with reference to the drawings. FIGS. 1 and 2 show the appearance of the electric vacuum cleaner of a first embodiment. FIG. 1 is a perspective view of the cleaner as seen obliquely from the front. FIG. 2 is a back view of the cleaner. Some inner parts of the cleaner are also shown in these figures. This electric vacuum cleaner includes a body 1 and a nozzle 3. The nozzle 3 is fitted to the bottom of the body 1 so that the cleaner is of upright type. The body 1 includes a handle 2 formed at its top for moving the cleaner.

The cleaner body 1 has a fan chamber 12 formed in its bottom, which houses an electric fan 13 for producing an air flow. The body 1 also has a dust chamber 14 formed over the fan chamber 12. The dust chamber 14 houses a dust bag 15. The front of the body 1 is closed with a cover 11*b*, which can be opened so that a dust bag 15 can be put into and taken out of the chamber 14. The closure of the cover 11*b* this chamber 14 tightly. The upstream (suction stream) side of the fan chamber 12 communicates with the dust chamber 14.

The cleaner body 1 has outlet slits 11*c* formed through a left portion of its front to discharge part of the slip stream from the fan 13 out of the cleaner. The body 1 also has a recess or cavity 11*d* formed in its back for the user to carry the cleaner. The cleaner includes a power switch 16 and a power cord 17. The body 1 is fitted with rear wheels 18 at its bottom to move around.

The nozzle 3 includes a case 31 and a bottom cover 32, which is screwed to the case 31. The nozzle 3 is fitted with a rotating brush 5 covered with the case 31 and the cover 32. The nozzle 3 and the cleaner body 1 are connected by a suction-side hose 6 and a discharge-side hose 7. The suction-side hose 6 connects the inside of the nozzle 3 and the dust chamber 14. The discharge-side hose 7 connects the downstream (slip stream) side of the fan chamber 12 and the inside of the nozzle 3 through the rotating brush 5.

Figure 3:
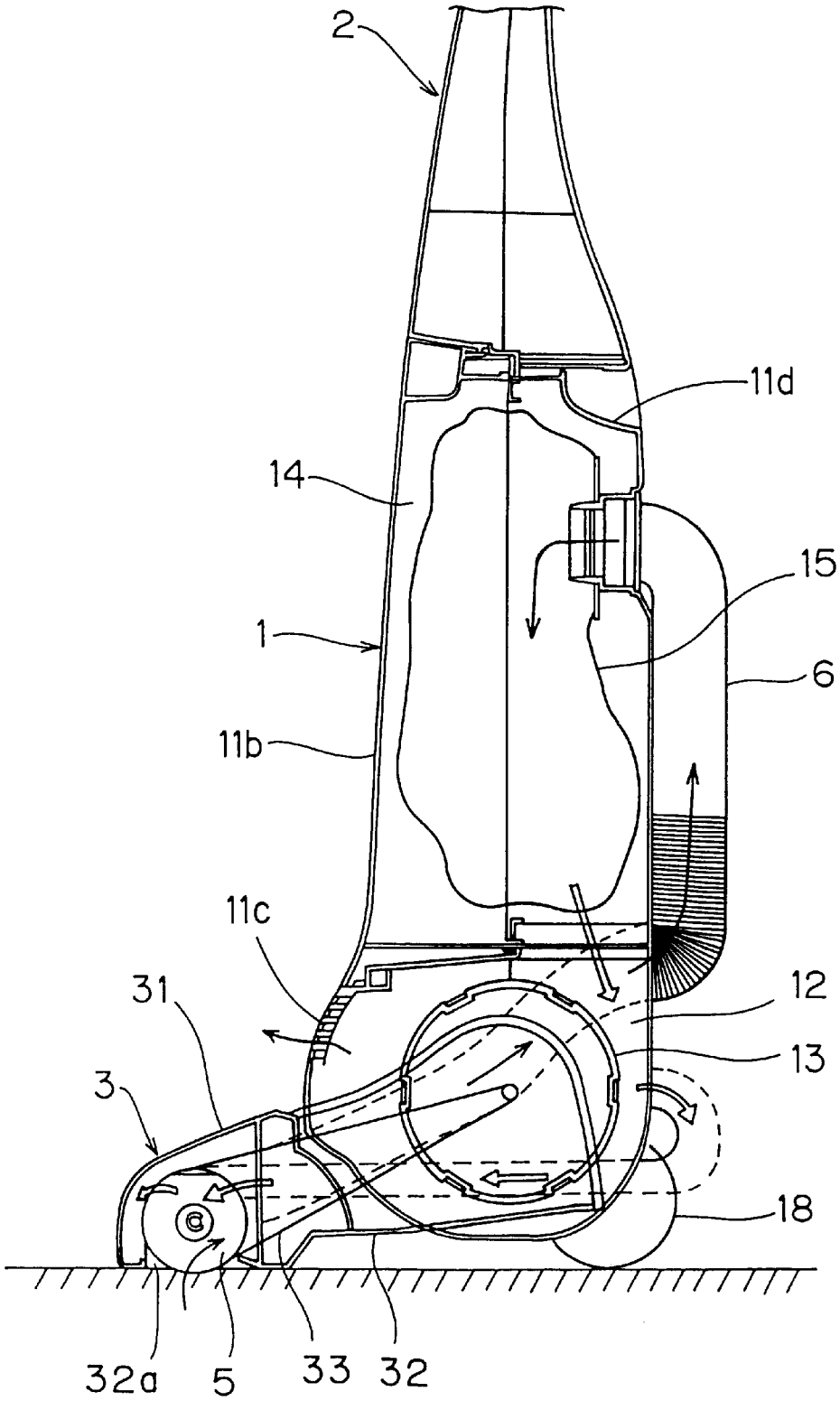
FIG. 3 is a sectional side view of the cleaner according to the first embodiment.
Figure 4:
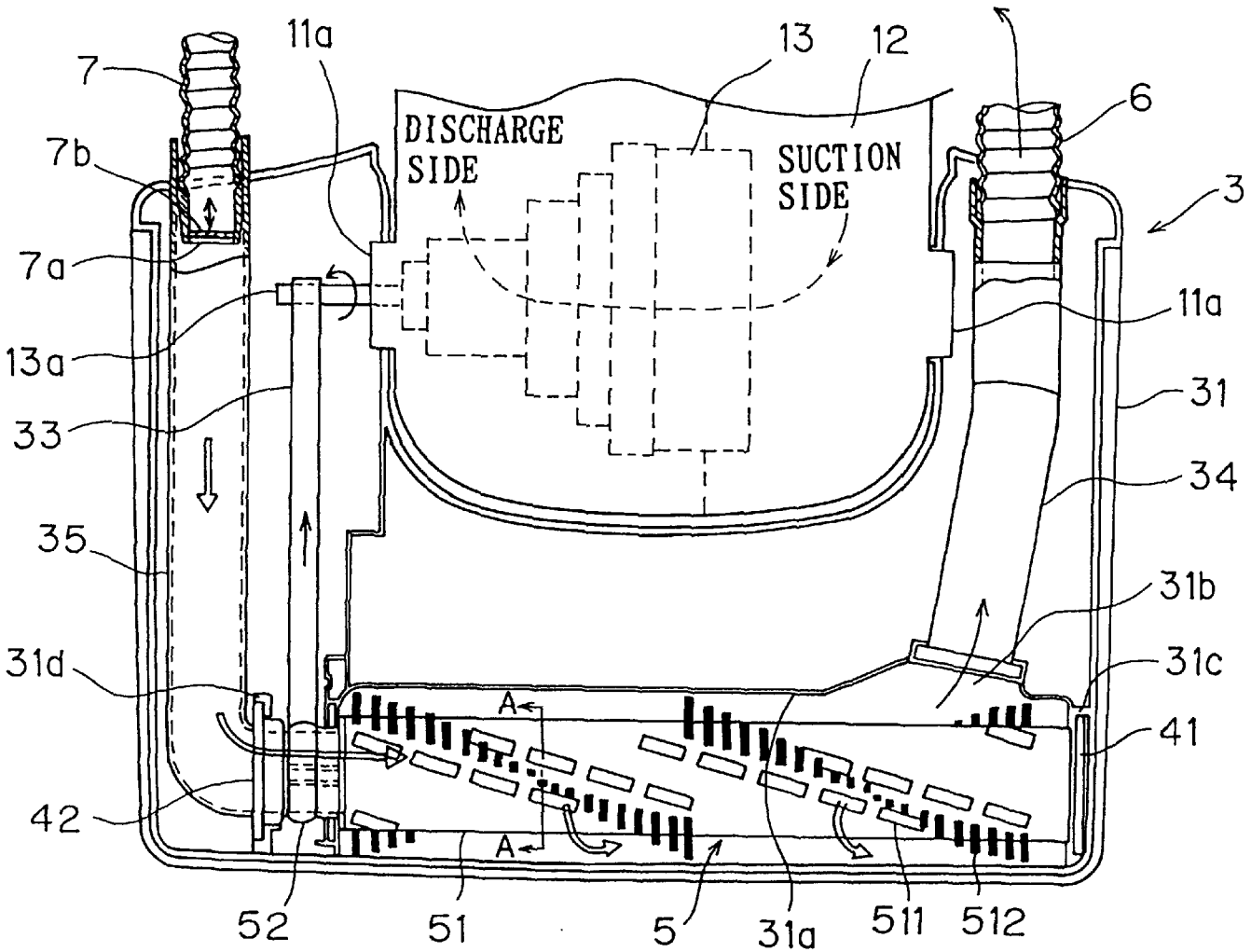
FIG. 4 is a bottom view of the cleaner according to the first embodiment with its nozzle bottom cover removed.

FIG. 3 shows a section of the cleaner as seen from the left side, and FIG. 4 shows the nozzle 3 with the cover 32 removed as seen from the bottom. The cleaner body 1 includes bosses 11*a* formed on both its sides near its bottom. The nozzle 3 is supported on the bosses 11*a* pivotably in the backward and forward directions.

The rotating brush 5 extends near the front end of the nozzle 3 horizontally between the right and left sides of the nozzle. The brush 5 has a pulley 52 fixed to its one end. The pulley 52 is connected to the shaft 13*a* of the fan 13 by a belt 33. The belt 33 transmits the rotation of the fan 13 to the pulley 52 to rotate the brush 5. The bottom cover 32 has a laterally long suction opening 32*a* at the position facing the brush 5, and the rotating brush 5 is exposed to the outside through the suction opening 32*a*.

The inside of the nozzle 3 is partitioned by a wall 31*a* formed behind the rotating brush 5. The wall 31*a* has a suction opening 31*b* formed near its right end. Behind the suction opening 31*b* a suction-side connecting pipe 34 is arranged, whose front end and rear end are connected to the opening 31*b* and to the suction-side hose 6, respectively.

On the left side in the nozzle 3 a discharge-side connecting pipe 35 is arranged, into the rear end of which is inserted an end 7*a* of the discharge-side hose 7. The discharge-side hose 7 is flexible, and the user can freely connect or disconnect the hose end 7*a* to or from the rear end of the pipe 35. The peripheral surface of the end 7*a* tapers off for easy connection and disconnection. The end 7*a* is fitted with a removable filter 7*b* in order to capture fine dust which has leaked from the dust bag 15.

Figure 5:
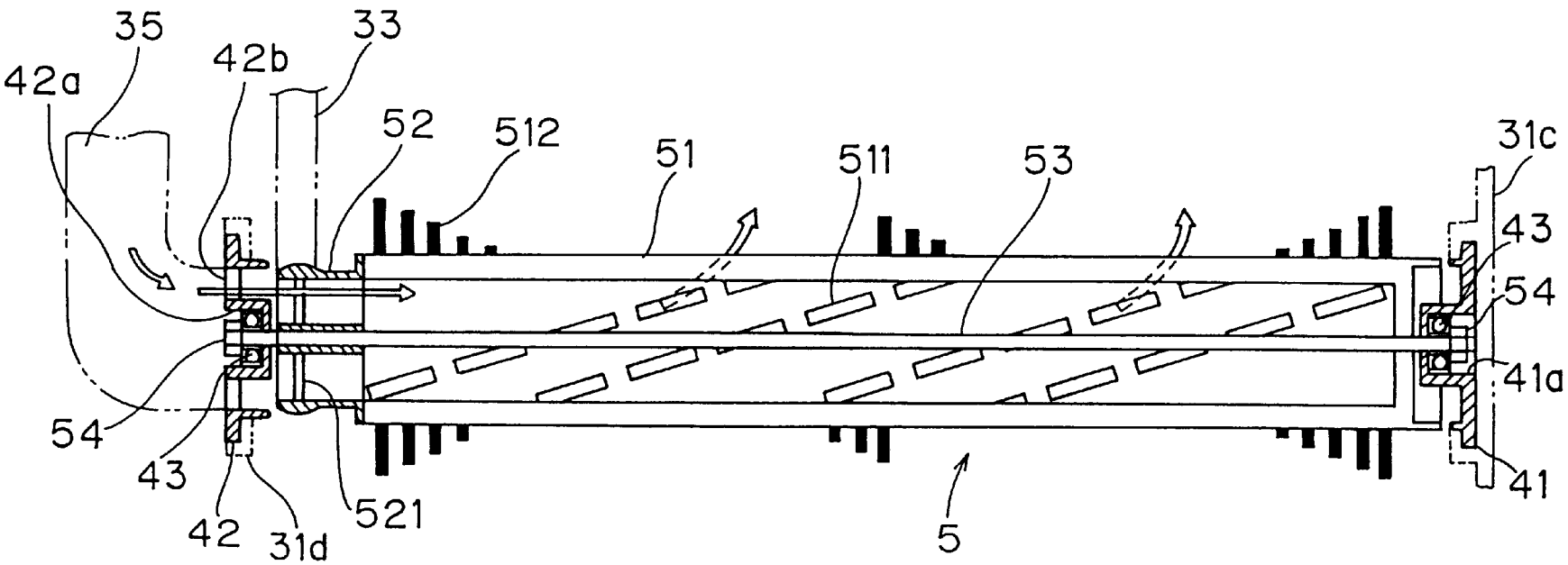
FIG. 5 is sectional views of the rotating brush in the nozzle of the cleaner according to the first embodiment and the bearing holders in the nozzle.

FIG. 5 is sectional views of the rotating brush 5 and the bearing holders 41 and 42 for supporting the rotating brush 5. The rotating brush 5 includes a hollow cylindrical rotor 51 and spiral rows of bristles 512 implanted in the outer surface of the rotor 51 and extending along the rotor. The rotor 51 has a number of air slots 511 formed to pass through its wall from the inside to the outer peripheral surface. In the rotor 51 is arranged a brush shaft 53 extending coaxially through the rotor 51 and protruding from both ends of the rotor. One end of the rotor 51 is closed, and the pulley 52 is fixed to the other end of the rotor.

The pulley 52 includes a boss and an outer peripheral part, which are connected by radial parts. The boss and the peripheral part are fixed to the brush shaft 53 and the rotor 51, respectively, with an adhesive or the like. This fixes the rotor 51, the pulley 52 and the shaft 53 together. The radial parts define spaces 521 between them.

The ends of the brush shaft 53 are supported by a pair of bearing holders 41 and 42, which have outer recesses 41*a* and 42*a*, respectively, formed in their centers. A bearing 43 is forced or press-fitted into each of the recesses 41*a* and 42*a*. Each end of the shaft 53 is forced into the associated bearing 43 and fitted with a nut 54 so that this shaft and the rotor 51 are supported rotatably. The holders 41 and 42 are fitted into ribs 31*c* and 31*d*, respectively, which are formed in the nozzle case 31, so that they are fixed in the nozzle 3.

The bearing holder 42 adjacent to the pulley 52 has openings 42*b*, to which the front end of the discharge-side connecting pipe 35 is fitted closely. The downstream side of the fan chamber 12 communicates with the inside of the rotating brush 5 through the discharge-side hose 7, the discharge-side connecting pipe 35, the holder openings 42*b* and the pulley spaces 521. The inside of the brush 5 communicates with the inside of the nozzle 3 through the slots 511. This forms a reflux passage for the slip stream from the fan 13.

Figure 6:
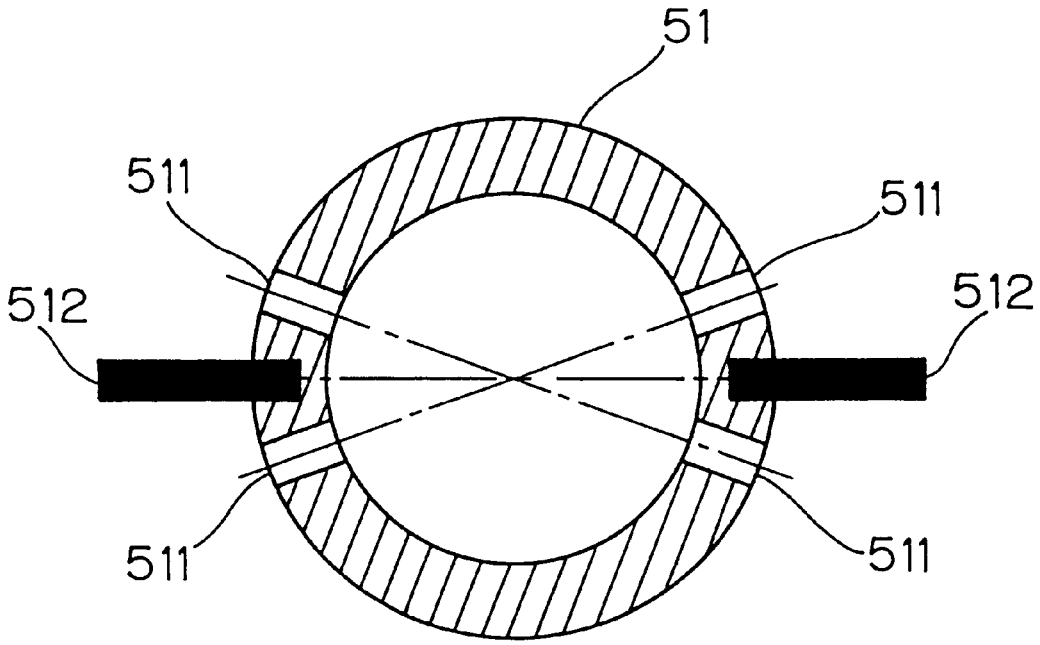
FIG. 6 is a sectional view taken on the line A—A of FIG. 4.

FIG. 6 shows a sectional view taken on the line A—A of FIG. 4. The bristles 512 are arranged in two spiral rows opposite each other, and the rows of the bristles 512 twist by 360 degrees between the both ends of the rotor 51. The slots 511 are arranged in two pairs of two spiral rows, so that the two rows of each pair extend along the row of the bristles 512 with the latter in between. The outer ends of the bristles 512 protrude slightly from the suction opening 32*a* without contacting the bottom cover 32. The rotating brush 5 is rotated counterclockwise in FIG. 3 and the bristles 512 brush the surface under the nozzle 3 backward. This separates dust from the surface being cleaned. The rows of bristles 512 and slots 511 might be arbitrary in number and shape.

The air flow in this cleaner will be described below. When the power switch 16 is turned on to supply the electric power, the electric fan 13 and the brush 5 rotate at the same time. The rotation of the fan 13 develops suction force, which sucks air through the suction opening 32*a* into the nozzle 3. The sucked air flows through the wall opening 31*b*, the suction-side connecting pipe 34 and the suction-side hose 6 in order into the dust bag 15. Air leaks out of the bag 15 and reaches the suction side of the fan chamber 12. This upstream flow to the fan 13 sucks dust on the surface under and around the nozzle 3. The sucked dust is collected in the bag 15.

The air on the suction side of the fan chamber 12 is sent to the discharge side of this chamber and forms a slip stream. Part of the slip stream is discharged out of the cleaner body 1 through the outlet slits 11*c*. The remainder of the slip stream flows through the discharge-side hose 7, the discharge-side connecting pipe 35, the holder openings 42*b* and the pulley spaces 521 in order into the inside of the rotating brush 5. The air in the brush 5 then jets out through the slots 511 into the inside of the nozzle 3. The rotation of the brush 5 causes the slots 511 to face downward in a cycle. Part of the jetting air strikes the surface under the nozzle 3 and separates dust from it. The air jetting out through the slots 511 is sucked through the wall opening 31*b* by the suction force of the fan 13, and circulates through the above-mentioned circulation passage.

The air jetting out through the brush slots 511 acts to prevent dust from clinging to the bristles 512, and to blow clinging dust off them. This air does not flow out of the nozzle 3, and therefore does not blow dust off the surface around the nozzle 3. Even if the suction opening 32*a* in the bottom of the nozzle 3 is blocked with a carpet or the like, which is flexible, the inside of the nozzle 3 is kept supplied with circulating air. Therefore, the suction force of the cleaner does not decrease.

Because the filter 7*b* is fitted at the end 7*a* of the discharge-side hose 7, fine dust is hardly contained in the air jetting out through the brush slots 511. Therefore, dust does not stick again to a surface which has been cleaned by the cleaner. Because the filter 7*b* can be removed, it is easy to clean the filter.

The outer peripheral surface of the filter 7*b* is threaded, and the inner peripheral surface of the hose end 7*a* is threaded for engagement with the filter 7*b*. The filter 7*b* might be fitted in another way. The filter 7*b* might be positioned in the cleaner body 1, the discharge-side hose 7 or the discharge-side connecting pipe 35. It is essential that the filter 7*b* be positioned in the passage through which the slip stream from the fan 13 flows to the rotating brush 5.

When the discharge-side hose 7 is not connected to the discharge-side connecting pipe 35, the slip stream from the fan 13 is discharged from the hose end 7*a*. In this case, the discharge-side hose 7 can be used as a blower for blowing off dust. This upright cleaner can be used mainly for cleaning flat floors, but may also be used for cleaning others than them with the blower.

Hereinafter other embodiments of the present invention will be described. These cleaners differ only in the nozzle structure from the foregoing cleaner. The same reference numerals are accorded to identical and similar parts, and redundant or duplicate explanations of these parts will be omitted.

Figure 7:
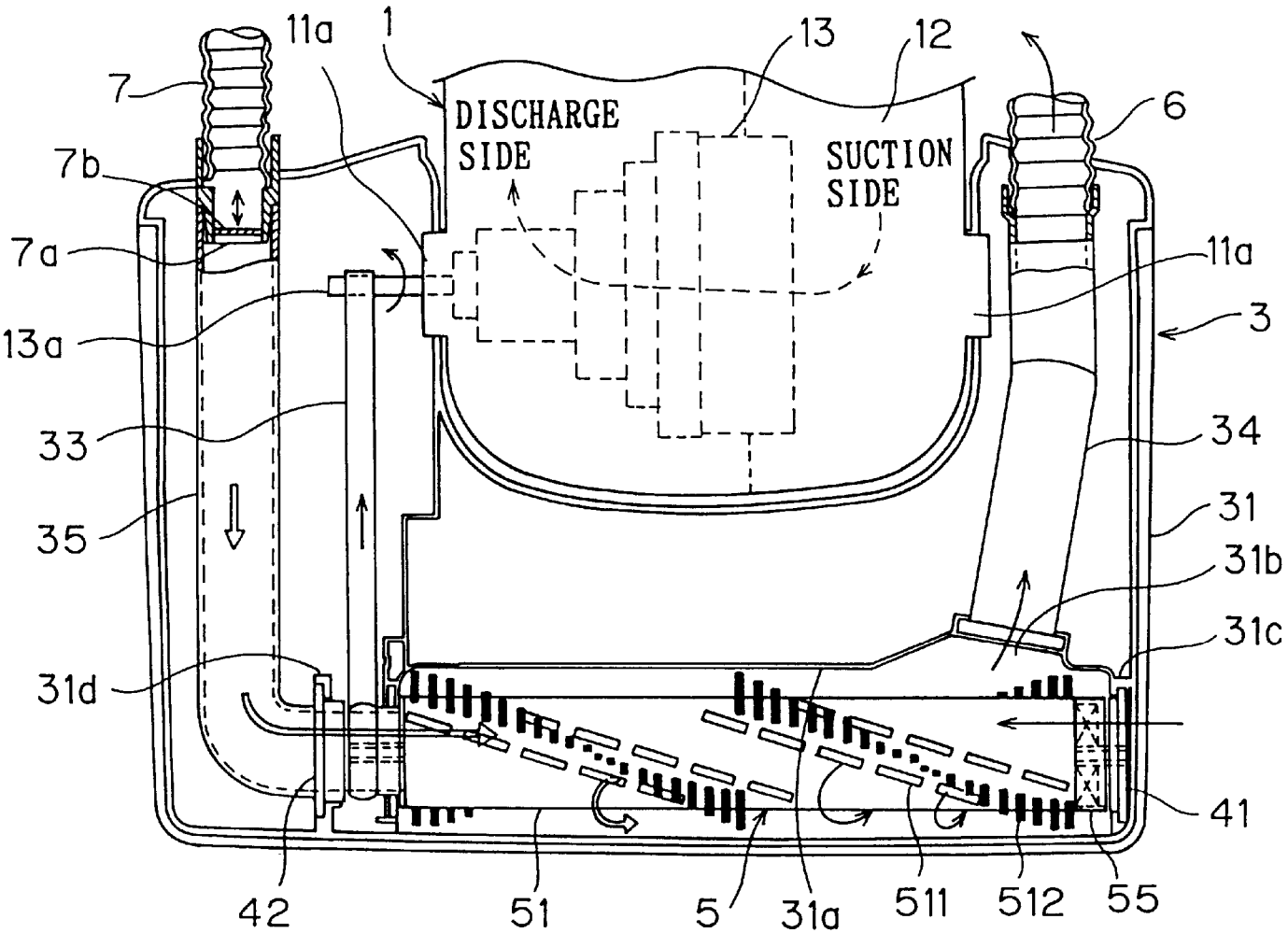
FIG. 7 is a bottom view of an electric vacuum cleaner according to a second embodiment of the invention with its nozzle bottom cover removed.
Figure 8:
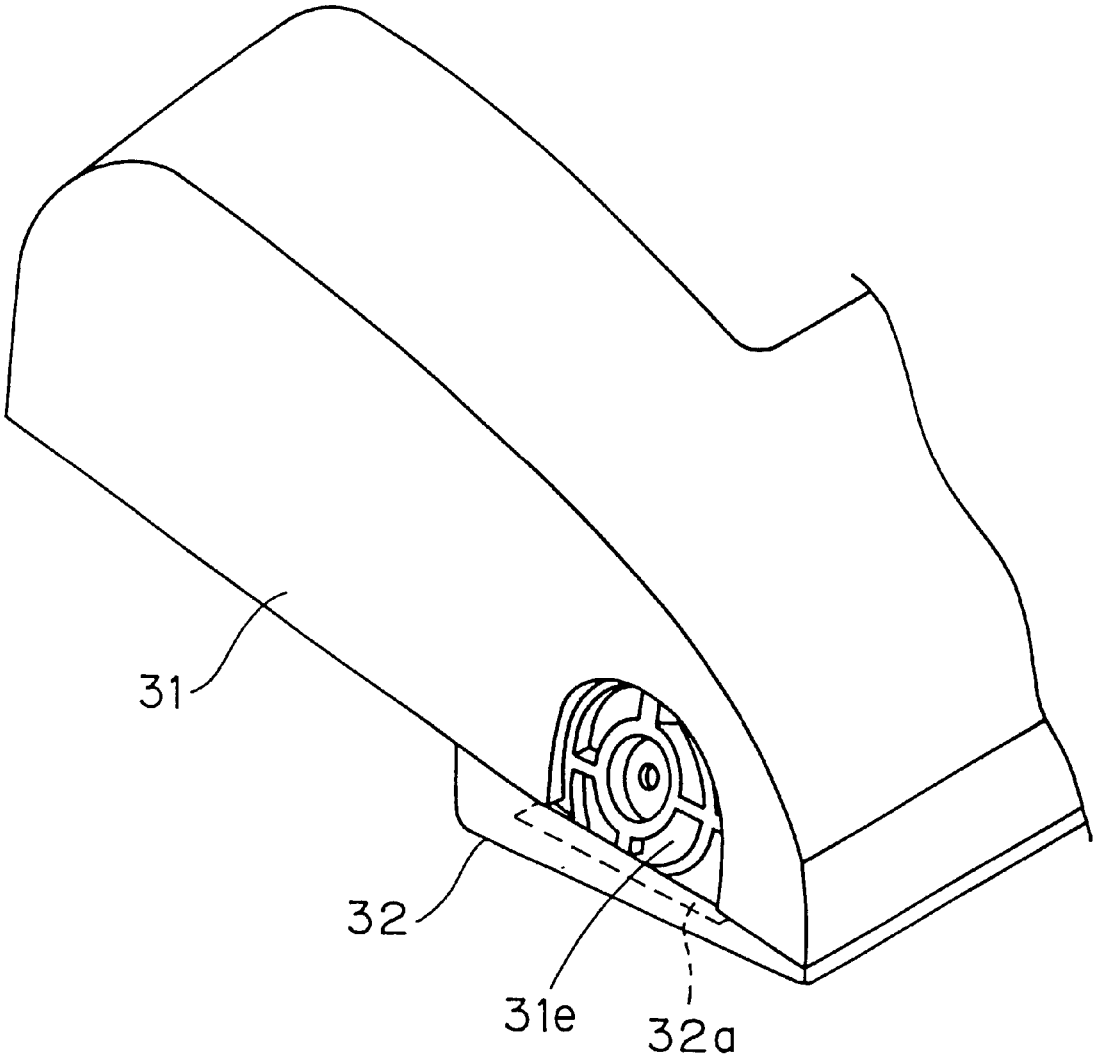
FIG. 8 is a fragmentary perspective view of the nozzle case of the cleaner according to the second embodiment.
Figure 9:
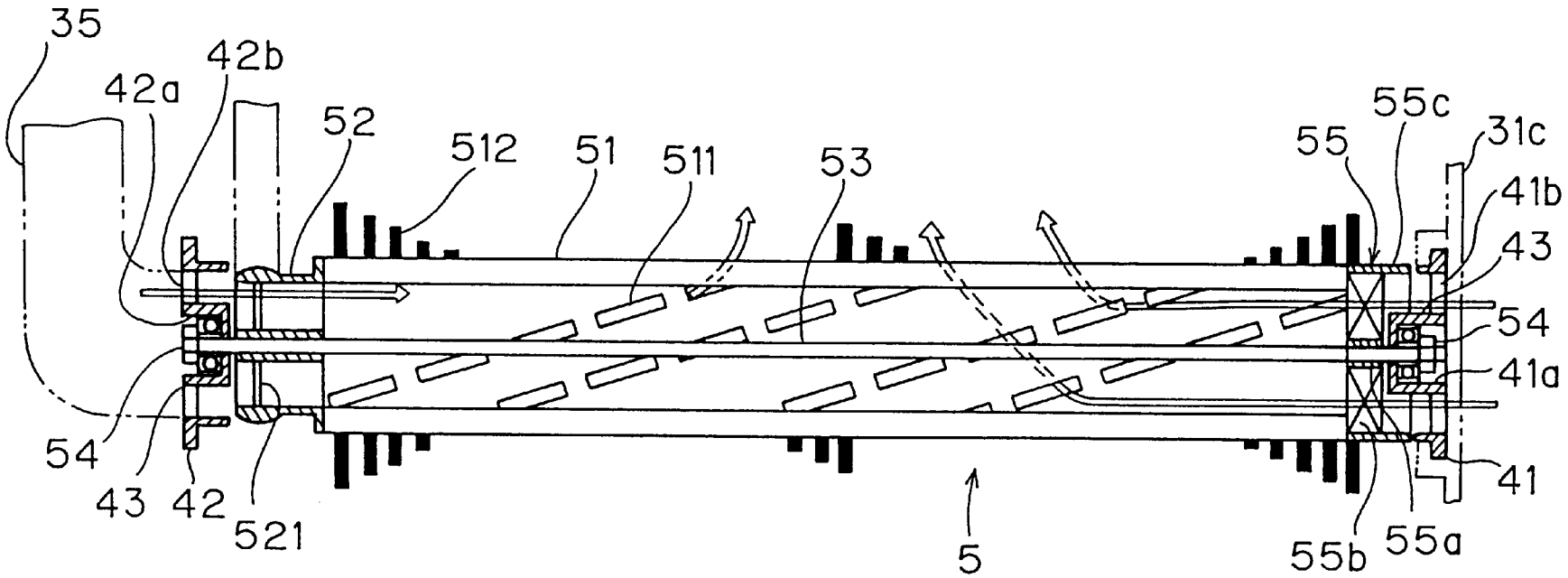
FIG. 9 is sectional views of the rotating brush in the nozzle of the cleaner according to the second embodiment and the bearing holders in this nozzle.

FIGS. 7 to 9 show the nozzle 3 of the cleaner according to a second embodiment. FIG. 7 is a bottom plan view of the nozzle 3 with the bottom cover 32 removed, FIG. 8 is a partial perspective view of the nozzle case 31, and FIG. 9 is sectional views of the rotating brush 5 and the bearing holders 41 and 42.

The end of the rotor 51 opposite the pulley 52 is open, and a suction or intake fan 55 is fitted thereto. The bearing holder 41 to support the end of the brush shaft 53 protruding therefrom has an opening 41*b* like the bearing holder 42 to support the other end of the brush shaft 53. That end of the brush shaft 53 is fitted to the bearing holder 41 in the same way as described above. The nozzle case 31 has an air intake hole 31*e* at the position facing the bearing holder 41. The inside of the hollow rotor 51 communicates with the outside of the nozzle 3 through the holder opening 41*b* and the intake hole 31*e*.

The suction fan 55 includes a central boss 55*a*, a peripheral wall 55*c* and blades 55*b*, which connect the boss 55*a* and the wall 55*c* and incline relative to the brush shaft 53. The boss 55*a* and the wall 55*c* are fixed to the shaft 53 and the end surface of the rotor 51, respectively, with an adhesive or the like. This fixes the rotor 51, the suction fan 55 and the brush shaft 53 together. The rotor 51 rotates together with the fan 55, which sucks air without resistance from the outside of the nozzle 3 into the rotor 51.

When the power switch 16 is turned on to supply the electric power, the electric fan 13 rotates together with the rotating brush 5 and the suction fan 55. The rotation of the electric fan 13 develops suction force, which sucks air from the outside of the nozzle 3 through the suction opening 32*a* into the nozzle. The sucked air circulates through the circulation passage as described for the first embodiment. In addition, in this embodiment, the suction fan 55 sucks air from the outside of the nozzle 3 directly into the rotating brush 5. This sucked air mixes with the air which has returned through the reflux passage into the brush 5 and jets out through the slots 511 of the brush 5.

As the dust collected in the dust bag 15 increases in quantity, the air sucked through the suction opening 32*a* into the nozzle 3 decreases in quantity, but the air sucked into the rotating brush 5 by the suction fan 55 increases in quantity. Therefore, irrespective of the amount of dust in the bag 15, dust is surely prevented from clinging to the bristles 512, and the cleaner capacity to suck dust from the surface under the nozzle 3 is kept high.

Even if the discharge-side hose 7 is disconnected from the discharge-side connecting pipe 35, the suction fan 55 sucks air into the rotating brush 5, and the sucked air jets out through the brush slots 511 into the inside of the nozzle 3. This contributes greatly to the prevention of dust from clinging to the bristles 512 and the maintenance of high cleaner capacity to suck dust. It might therefore be possible to omit the reflux passage extending from the discharge side of the fan chamber 12 to the rotating brush 5.

Figure 10:
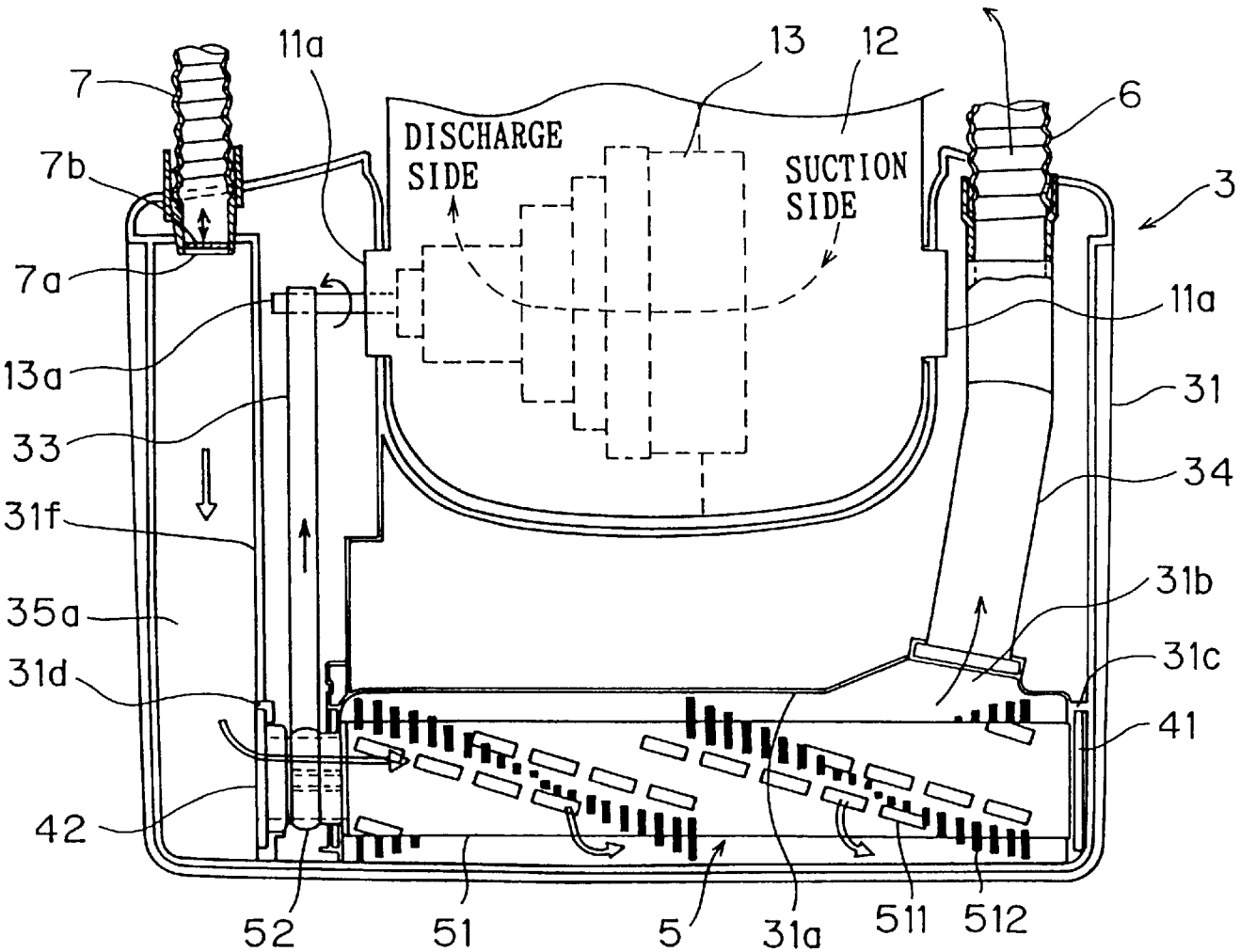
FIG. 10 is a bottom view of an electric vacuum cleaner according to a third embodiment of the invention with its nozzle bottom cover removed.

The electric vacuum cleaner of a third embodiment will be described. FIG. 10 is a bottom plan view of the nozzle 3 in this embodiment with the cover 32 removed. In the first embodiment, the discharge-side connecting pipe 35 is provided in the nozzle 3 and this pipe 35 is used as a part of the reflux passage from the discharge side of the fan chamber 12 to the rotating brush 5. In this embodiment, however, the inside of the nozzle case 31 is partitioned to form a discharge-side connecting chamber 35*a* and this chamber 35*a* is used as the part of the reflux passage within the nozzle 3.

The nozzle case 31 is made of resin. When the case 31 is molded out of resin, a partition wall 31*f* is formed in it. When the bottom cover 32 is fitted to the nozzle case 31, the bottom of the wall 31*f* is in close contact with the upper surface of the cover 32. The wall 31*f* connects with ribs 31*d*, which hold the bearing holder 42. Therefore, the connecting chamber 35*a* communicates with the inside of the rotating brush 5. The wall 31*f* has an opening formed through its rear end for inserting the discharge-side hose 7, and the end 7*a* of the hose 7 can be connected to the opening removably.

According to this structure, it is not necessary to provide a member like the connecting pipe 35. Therefore, the nozzle 3 is easier to assemble and can be manufactured at lower costs.

Figure 11:
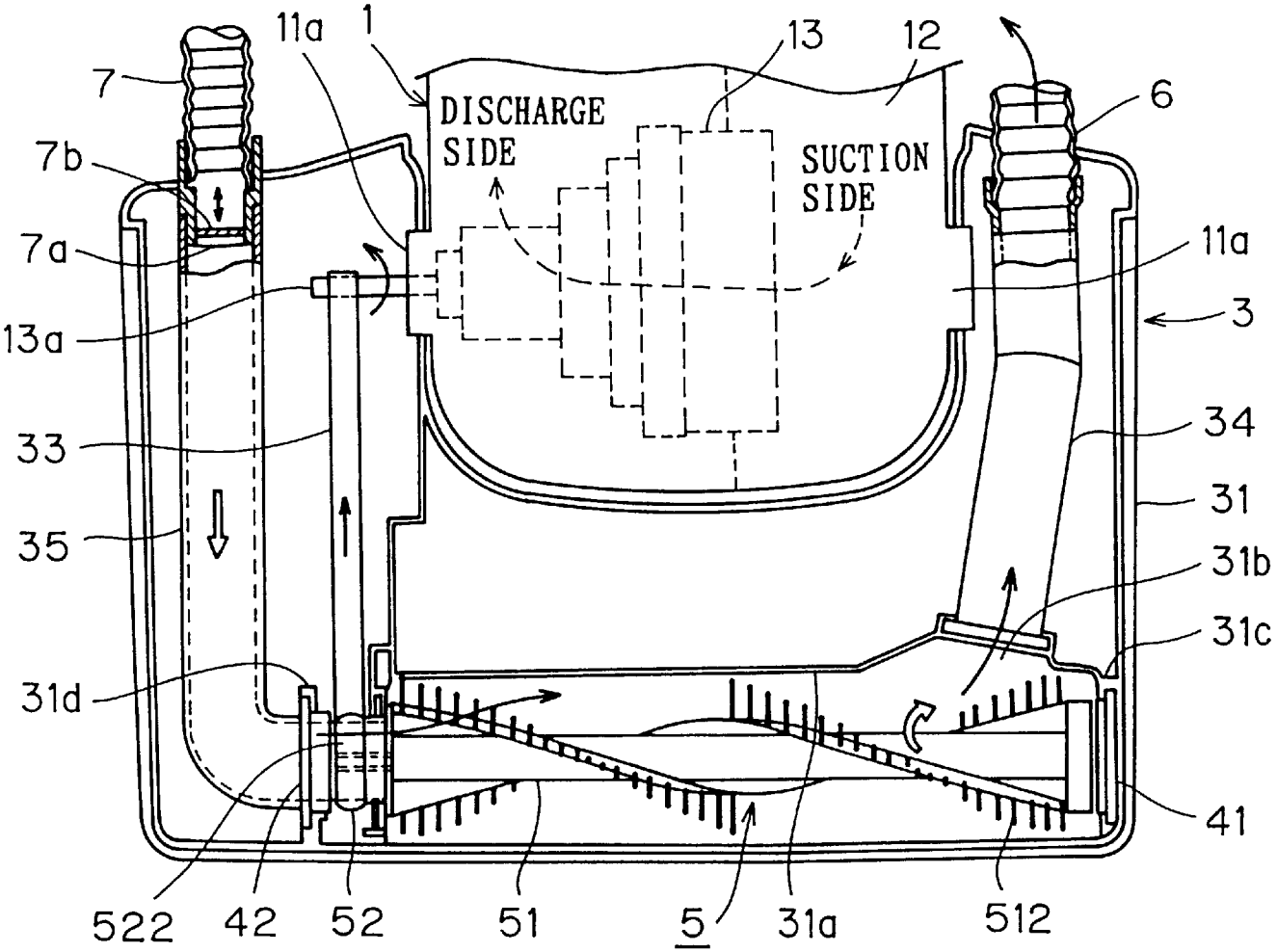
FIG. 11 is a bottom view of an electric vacuum cleaner according to a fourth embodiment of the invention with its nozzle bottom cover removed.
Figure 12:
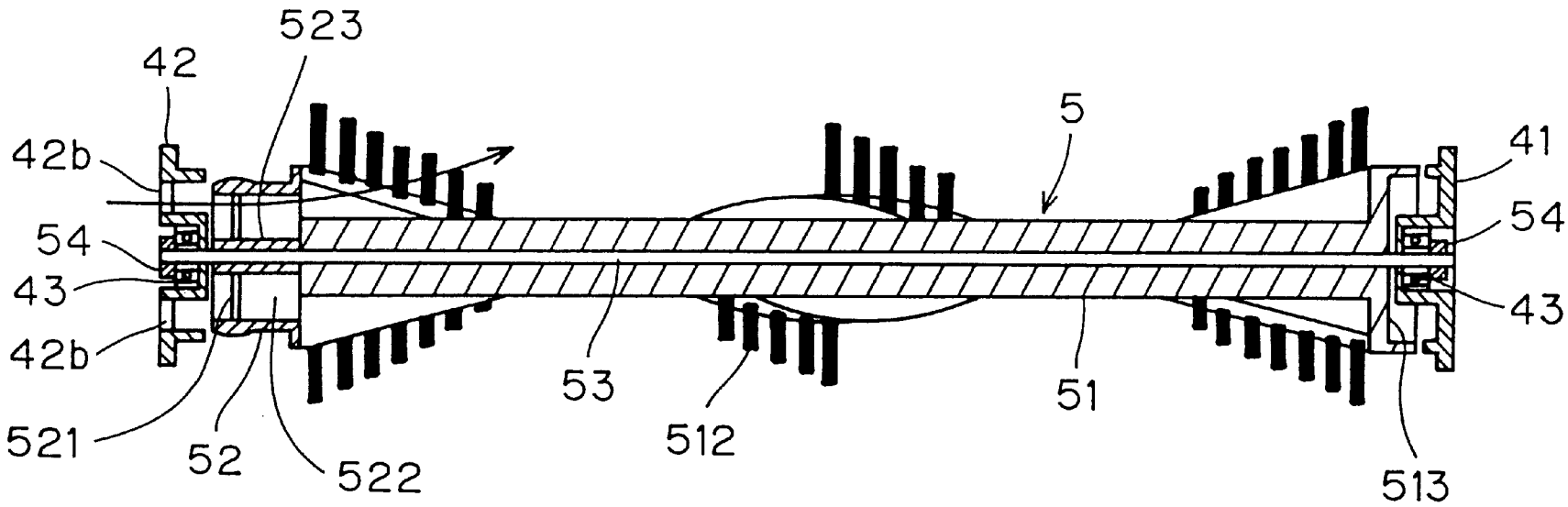
FIG. 12 is sectional views of the rotating brush in the nozzle of the cleaner according to the fourth embodiment and the bearing holders in this nozzle.

The electric vacuum cleaner of a fourth embodiment will be described. FIG. 11 is a bottom plan view of the nozzle 3 in this embodiment with the cover 32 removed, and FIG. 12 is sectional views of the rotating brush 5 and the bearing holders 41 and 42 for supporting the brush 5. The rotating brush 5 includes a rotor 51 having two spiral ridges or ribs formed on its outer surface and bristles 512 implanted in the peripheral surfaces of the ridges of the rotor 51. The rotor 51 is made by molding out of resin and has a central bore, through which the brush shaft 53 extends. The rotor 51 does not have air slots like the slots 511, which are formed through the cylindrical walls of the rotors 51 of the first to third embodiments.

A pulley 52 is bonded or otherwise fixed to the end at the discharge side of the rotor 51. The pulley 52 includes an outer peripheral part, which engages with the belt 33. The pulley 52 also includes a boss 523 having a central bore formed through it, through which the brush shaft 53 extends. The peripheral part and the boss 523 are connected by radial ribs 521, which define spaces between them. The inside of the pulley 52 is an air passage 522, through which the slip stream from the electric fan 13 flows axially. The other end of the rotor 51 near the suction opening 31*b* includes a flange 513 and a short cylinder axially extending from the flange 513 to form a concave therein. The flange 513 prevents the sucked air from passing through it and dust from flying about.

In order to reflux a larger quantity of slip stream from the fan 13, it is preferable that the air passage 522 in the pulley 52 be as large as possible in diameter and area, but the passage diameter and area are limited by the pulley diameter. The quantity of air flowing through the passage 522 depends on the area of the outlet slits 11*c* of the cleaner body 1, but can also be adjusted arbitrarily with the rotational speed of the rotor 51.

Bearing holders 41 and 42 support both ends of the brush shaft 53 through bearings 43. The ends of the shaft 53 are fitted with nuts 54 to be kept on the bearings 43. The bearing holder 42 near the pulley 52 has openings 42*b*, through which the slip stream from the fan 13 flows into the air passage 522 in the pulley 52. The bearing holder 41 near the flange 513 has no opening. The holders 41 and 42 are fitted to the ribs 31*c* and 31*d*, respectively, which are formed on the nozzle case 31. The holders 41 and 42 are fixed to the ribs 31*c* and 31*d* by the bottom cover 32 fitted to the bottom of the case 31. This causes the brush 5 to be supported rotatably, and brings the holder 42 into close contact with the front end of the discharge-side connecting pipe 35.

The air flow in this cleaner will be described below. When the power switch 16 is turned on to supply the electric power, the electric fan 13 and the rotating brush rotate at the same time. The rotation of the fan 13 develops suction force, which sucks air through the suction opening 32*a* into the nozzle 3. The sucked air flows through the wall opening 31*b*, the suction-side connecting pipe 34 and the suction-side hose 6 in order into the dust chamber 14. Air leaks out of the dust bag 15 in the chamber 14 and reaches the suction side of the fan chamber 12. The upstream flow to the fan 13 sucks dust on the surface under and around the nozzle 3. The sucked dust is collected in the bag 15.

The air on the suction side of the fan chamber 12 is sent to the discharge side of this chamber and forms a slip stream. Part of the slip stream is discharged out of the cleaner body 1 through the outlet slits 11*c*. The remainder of the stream flows through the discharge-side hose 7, the discharge-side connecting pipe 35, the openings 42*b* of the bearing holder 42 and the air passage 522 of the pulley 52 in order, and jets to the outside of the rotating brush 5. The jetting air flows along the spiral ridges of the brush 5. Part of the air blowing through the spaces between the bristles 512 strikes the surface under the nozzle 3, and separates dust from it. The air around the brush 5 is sucked through the wall opening 31*b*, and circulates through the circulation passage.

The air (slip stream) jetting to the rotating brush 5 acts to prevent dust from clinging to the bristles 512, and to blow clinging dust off them. This air does not flow out of the nozzle 3, and therefore does not blow dust off the surface around the nozzle 3. Even if the suction opening 32*a* in the bottom of the nozzle 3 is blocked with a thick carpet or the like, which is flexible, the inside of the nozzle 3 is supplied with circulating air. Therefore, the suction force of the cleaner does not decrease greatly.

In comparison with the first to third embodiments, the cylindrical wall of the rotor 51 included in the rotating brush 5 can be thick, but the rotor can be small in outer diameter. This enables the nozzle 3 to be smaller, but keeps the rotating brush 5 high in strength. Further, It is not necessary to form air slots through the cylindrical wall of the rotor 51, and therefore the manufacturing efficiency is improved.

The peripheral surface of the rotor 51 might be cylindrical without spiral ridges. It is preferable, however, that the rotor 51 should have spiral ridges, because their side surfaces make it easier to direct to the surface under the nozzle 3 the slip stream from the fan 13 which jets to the outside of the rotor 51. This makes it easier to separate dust from the surface being cleaned.

Instead of providing the discharge-side connecting pipe 35 in the nozzle 3, the inside of the nozzle case 31 might be partitioned to form the discharge-side connecting chamber 35*a* as part of the reflux passage, like in the third embodiment.

Figure 13:
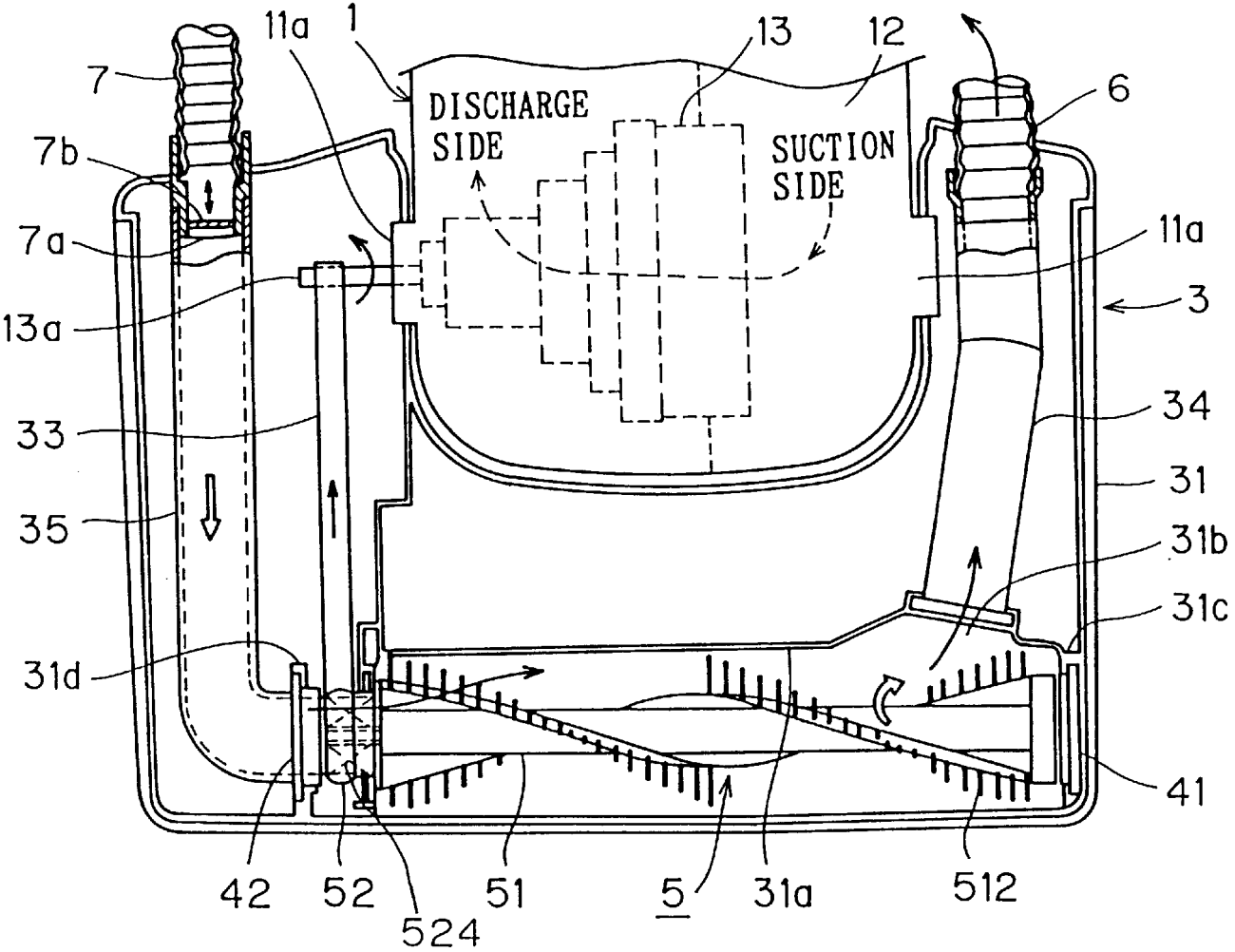
FIG. 13 is a bottom view of an electric vacuum cleaner according to a fifth embodiment of the invention with its nozzle bottom cover removed.
Figure 14:
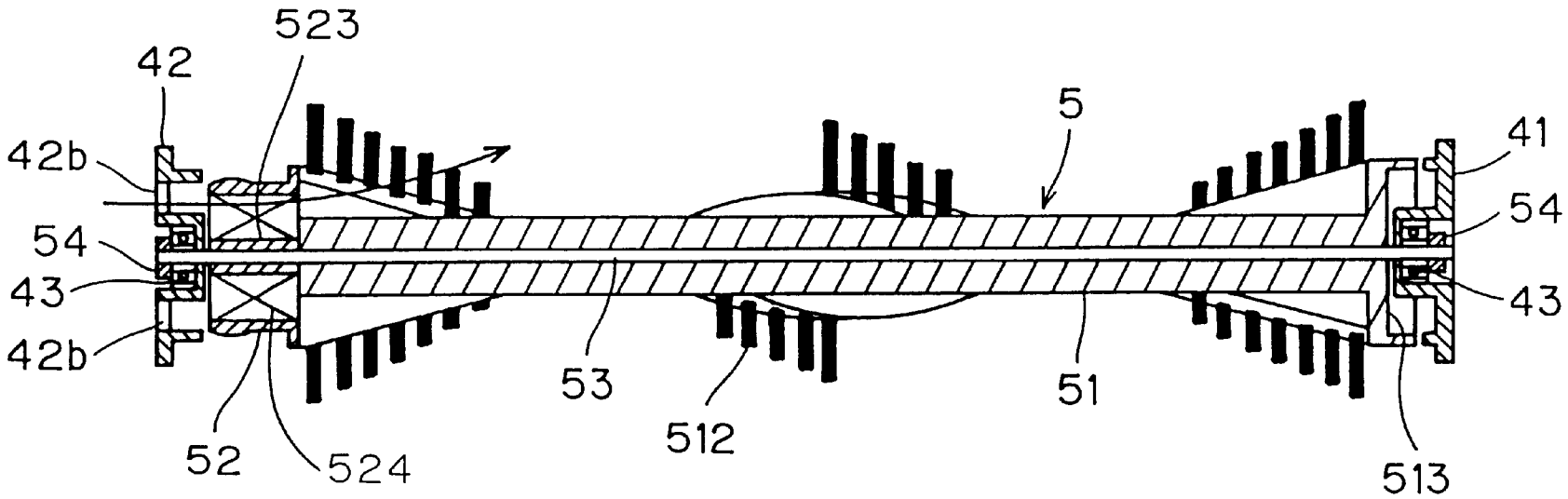
FIG. 14 is sectional views of the rotating brush in the nozzle of the cleaner according to the fifth embodiment and the bearing holders in this nozzle.

A fifth embodiment will be described. The electric vacuum cleaner of this embodiment is different from that of the fourth embodiment in the structure of the nozzle 3. FIG. 13 is a bottom plan view of the nozzle 3 with the cover 32 removed, and FIG. 14 is sectional views of the rotating brush 5 and the bearing holders 41 and 42 provided in the nozzle 3.

The rotating brush 5 includes the rotor 51 having the two spiral ridges formed on its outer surface and the bristles 512 implanted in the peripheral surfaces of the ridges of the rotor 51. The rotor 51 is made by molding out of resin and has a central bore, through which the brush shaft 53 extends.

A pulley 52 is bonded or otherwise fixed to the end of the rotor 51 in the downstream side. The pulley 52 includes an outer peripheral part, which engages with the belt 33. The pulley 52 also includes a boss 523 having a central bore formed through it, through which the brush shaft 53 extends. The peripheral part and the boss 523 are connected by radial fan blades 524. The fan blades 524 not only define air passages between them, but also send air actively to the outside of the rotating brush 5 by its rotation. The other end of the rotor 51 near the suction opening 31*b* includes the flange 513 and the short cylinder axially extending from the flange 513. The flange 513 prevents the sucked air from passing through it and dust from flying about.

The way of supporting the rotating brush 5 with bearing holders 41 and 42 is similar to that for the fourth embodiment. The performance of the fan blades 524 in the pulley 52 can be adjusted by their radius, shape and rotational speed.

This cleaner has an air circulation passage substantially similar to that of the fourth embodiment, but the fan blades 524 can send the slip stream from the electric fan 13 forcedly to the outside of the rotating brush 5. Even if the suction opening 32*a* in the bottom of the nozzle 3 is blocked, the blades 524 force circulating air to be supplied to the inside of the nozzle 3. This maintains the cleaner suction force longer and makes it less liable to lower, enabling more efficient cleaning.

Figure 15:
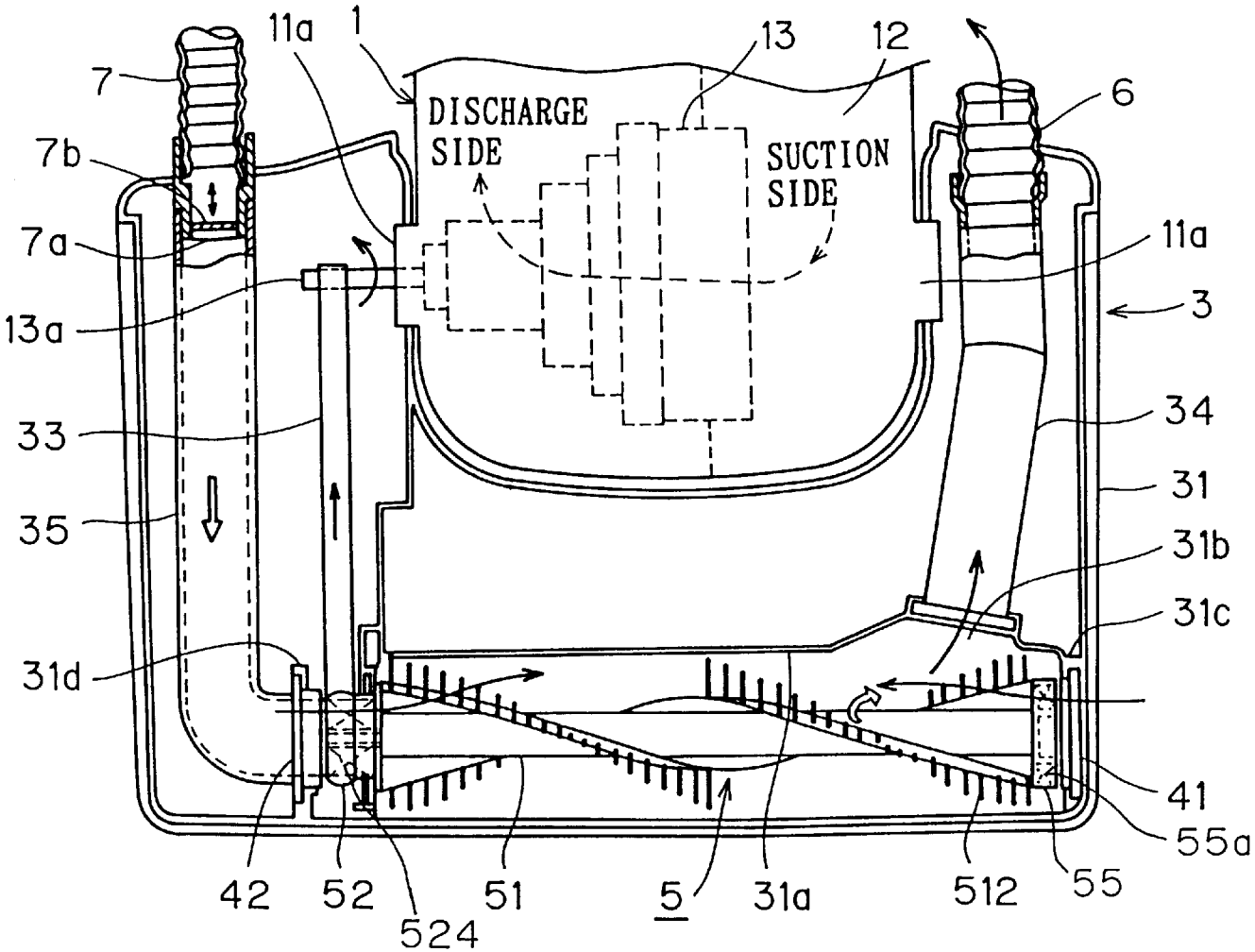
FIG. 15 is a bottom view of an electric vacuum cleaner according to a sixth embodiment of the invention with its nozzle bottom cover removed.

A sixth embodiment will be described. The electric vacuum cleaner of this embodiment is different from that of the fifth embodiment in the structure of the nozzle 3. FIG. 15 is a bottom plan view of the nozzle 3 with the cover 32 removed.

The nozzle case 31 of this cleaner has, on its right side wall and near its front end, the air intake hole 31*e* shown in FIG. 8 and explained in the second embodiment. This intake hole 31*e* is for taking air outside the nozzle 3 in to the outside of the rotating brush 5 by the rotation of the suction fan 55 shown in FIG. 15. It is therefore preferable that the intake hole 31*e* be positioned on or around the extension of the axis of the brush 5.

Figure 16:
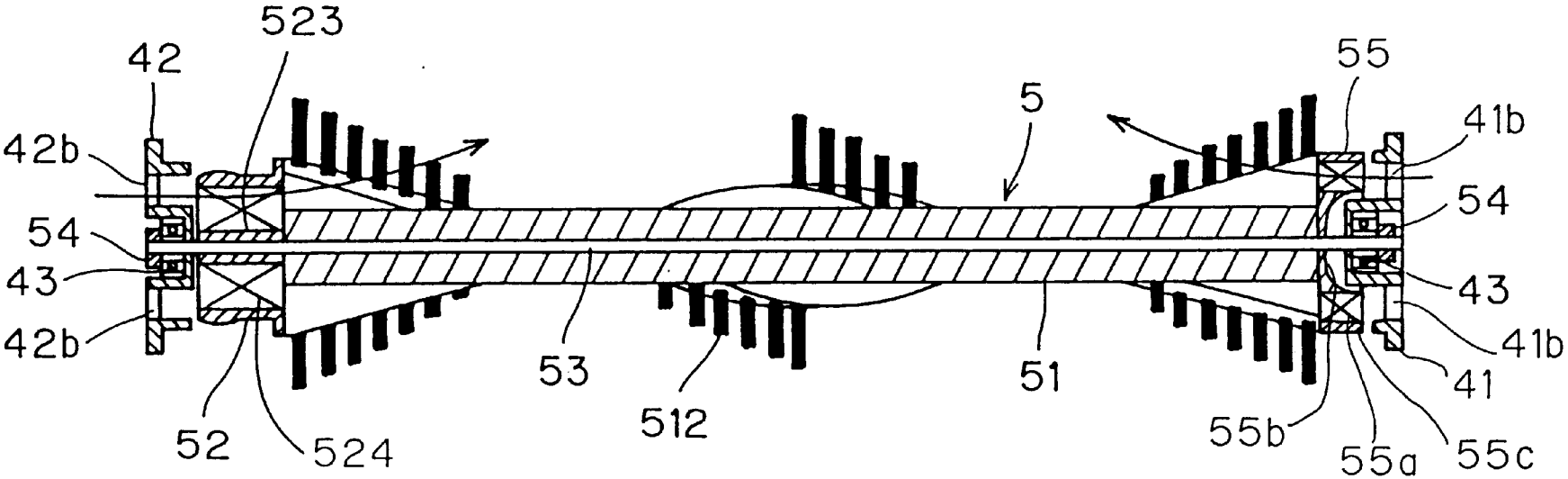
FIG. 16 is sectional views of the rotating brush in the nozzle of the cleaner according to the sixth embodiment and the bearing holders in this nozzle.
Figure 17:
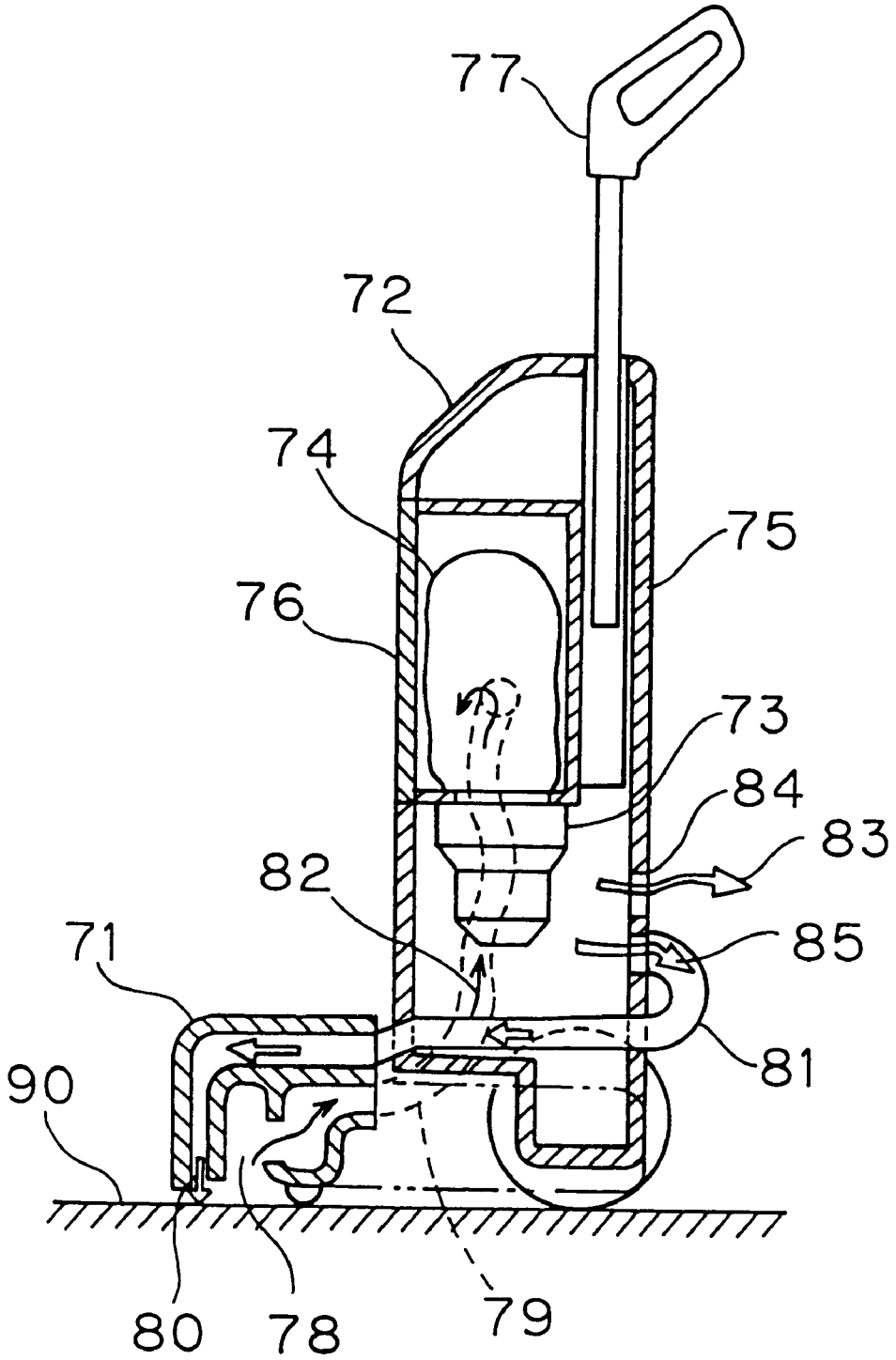
FIG.17 PRIOR ART
FIG. 17 is a sectional side view of a conventional electric vacuum cleaner.
Figure 18:
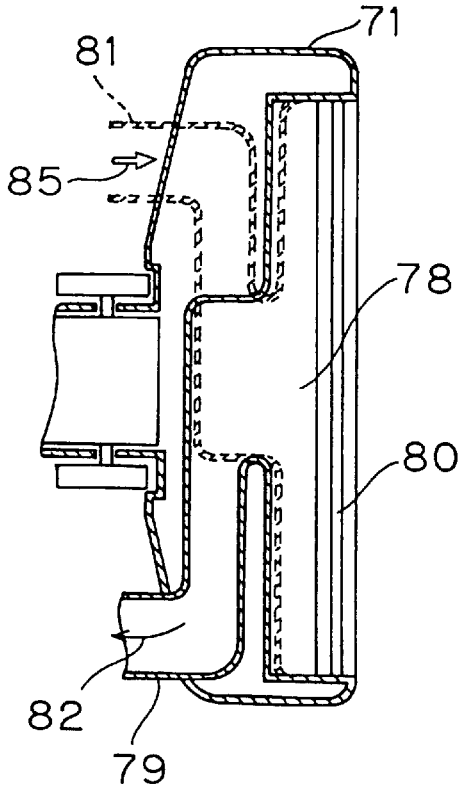
FIG.18 PRIOR ART
FIG. 18 is a sectional top view of the nozzle of the cleaner shown in FIG. 17.
Figure 19:
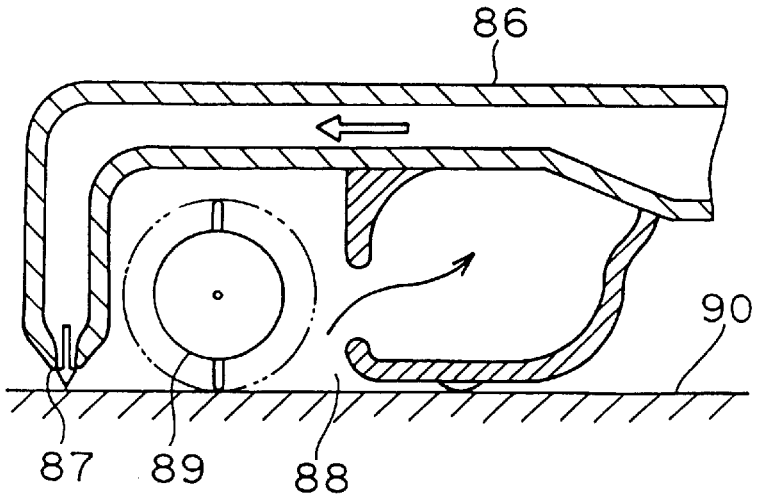
FIG.19 PRIOR ART
FIG. 19 is a sectional side view of another nozzle of a conventional electric vacuum cleaner.

Sectional views of the rotating brush 5 and the bearing holders 41 and 42 are shown in FIG. 16. The rotating brush 5 includes the rotor 51 having the two spiral ridges formed on its outer surface and the bristles 512 implanted in the peripheral surfaces of the ridges of the rotor 51. The rotor 51 is made by molding out of resin and has the central bore, through which the brush shaft 53 extends.

To the end of the rotor 51 in the downstream side, the pulley 52 having fan blades 524 therein is bonded or otherwise fixed, as explained in the fifth embodiment. A suction or intake fan 55 is fitted to the other end of the rotor 51 near the suction opening 31*b*. The suction fan 55 includes a central boss 55*b*, a peripheral wall 55*c* and a plurality of radial blades 55*a* for connecting the boss 55*b* and the peripheral wall 55*c* and for sending air toward the center of the nozzle 3 by rotation. After put on the brush shaft 53, the boss 55*b* is bonded or otherwise fixed to the end of the rotor 51. This fixes the rotor 51, the fan 55, the pulley 52 and the shaft 53 together.

The blades 55*a* of the suction fan 55 incline reversely to the fan blades 524 of the pulley 52 so that the rotation of the rotor 51 causes the fan 55 and the pulley 52 to send air in opposite directions (toward the center of the rotating brush 5).

Bearing holders 41 and 42 support both ends of the brush shaft 53 through bearings 43. The ends of the shaft 53 are fitted with nuts 54 to be kept on the bearings 43. The bearing holder 42 near the pulley 52 has openings 42*b*, through which the slip stream from the electric fan 13 can flow into the pulley 52. The bearing holder 41 near the suction fan 55 also has openings 41*b*, through which outside air can flow into the suction fan 55.

The bearing holders 41 and 42 are fitted to the ribs 31*c* and 31*d*, respectively, which are formed on the nozzle case 31. The holders 41 and 42 are fixed to the ribs 31*c* and 31*d* by the bottom cover 32 fitted to the bottom of the case 31. This causes the rotating brush 5 to be supported rotatably, and brings the bearing holder 42 into close contact with the front end of the connecting pipe 35. This also causes the openings 41*b* of the bearing holder 41 to face the air intake hole 31*e* formed through the right side wall of the nozzle 3 near its front end.

The air flow in this cleaner will be described below. The air on the suction side of the fan chamber 12 is sent to the discharge side of this chamber and forms a slip stream. Part of the slip stream is discharged out of the cleaner body 1 through the outlet slits 11*c*. The remainder of the stream flows through the discharge-side hose 7, the discharge-side connecting pipe 35, the openings 42*b* of the bearing holder 42 and the fan blades 524 in the pulley 52 in order, and jets to the outside of the rotating brush 5.

If the suction opening 32*a* in the bottom of the nozzle 3 is blocked, or as the dust collected in the dust bag 15 increase in quantity, the slip stream from the electric fan 13 decreases in quantity. When this stream decreases in quantity, air is sent without resistance from the outside the nozzle 3 through the intake hole 31*e* of the nozzle case 31, the holder openings 41*b* and the suction fan 55 in order to the outside of the rotating brush 5 by the fan 55 rotating with the brush 5. This air mixes with the slip stream jetting out through the pulley 52, and the mixture is sucked through the wall opening 31*b*, and circulates along the circulation passage.

The suction fan 55 and the intake hole 31*e* of the nozzle case 31 make it possible to take outside air in. This greatly prevents the cleaner suction force from decreasing, and therefore makes the cleaning efficiency higher. This also prevents dust from clinging to the bristles 512 at the position far from the pulley 52, which sends the slip stream from the electric fan 13. Besides, the temperature of the circulating air is restrained from rising, and therefore the life of the electric fan 13 is lengthened.

Instead of providing the fan blades 524 in the pulley 52, a simple air passage similar to the passage 522 of the fourth embodiment might be provided.

The cleaners according to the embodiments are upright cleaners. The invention may also be applied to a separate type cleaner, in which the nozzle is separated from the body, and they can move independently. In this case, it is required that the nozzle should have a motor for driving the rotating brush. It is also required that the nozzle and the body be connected by a tube or hose as the reflux passage in addition to a tube or hose as the suction passage. Because dust do not flow through the reflux passage, however, a small tube or hose diameter is sufficient for it. Therefore, the separate type cleaner does not need to be particularly large, and its operability is not worsened. If part of the reflux passage is defined by part of the nozzle case, as is the case with the third embodiment, the increase in weight of the nozzle can be a minimum.

Obviously, many modifications and variations of the present invention are possible in light of the above teachings. It is therefore to be understood that within the scope of the appended claims, the invention may be practiced other than as specifically described.

What is claimed is:

1. An electric vacuum cleaner comprising a body having an electric fan and a dust chamber, a nozzle having an opening at its bottom, a suction passage connecting an inside of said nozzle to said dust chamber, and a rotating brush including a rotor having bristles on a peripheral surface thereof and provided in said nozzle so as to rotate around an horizontal axis, and so operating that dust is sucked with air through the opening of said nozzle by an air flow produced by said electric fan through said suction passage, that sucked dust is collected in a dust bag housed in said dust chamber, and that a surface to be cleaned facing said opening is brushed by said rotating brush so as to promote separation of dust from the surface, characterized in that said rotor is a hollow cylinder having a through hole passing through a peripheral wall thereof, and that a reflux passage for guiding a slip stream of said electric fan to an inside of said rotor is provided so that the slip stream of said electric fan blows the surface to be cleaned through said through hole.

2. An electric vacuum cleaner as claimed in claim 1, wherein a removable filter for capturing fine dust is provided in said reflux passage.

3. An electric vacuum cleaner as claimed in claim 1, wherein a part of said reflux passage between said body and said nozzle comprises a flexible hose, and an end of the hose is attachable to and detachable from said nozzle.

4. An electric vacuum cleaner as claimed in claim 1, wherein a part of said reflux passage within said nozzle is formed by partitioning the inside of said nozzle with a part of a nozzle case constituting said nozzle.

5. An electric vacuum cleaner as claimed in claim 1, wherein said electric vacuum cleaner is of upright type with said nozzle being arranged at a bottom of said body.

6. An electric vacuum cleaner comprising a body having an electric fan and a dust chamber, a nozzle having an opening at its bottom, a suction passage connecting an inside of said nozzle to said dust chamber, and a rotating brush including a rotor having bristles on a peripheral surface thereof and provided in said nozzle so as to rotate around an horizontal axis, and so operating that dust is sucked with air through the opening of said nozzle by an air flow produced by said electric fan through said suction passage, that sucked dust is collected in a dust bag housed in said dust chamber, and that a surface to be cleaned facing said opening is brushed by said rotating brush so as to promote separation of dust from the surface, characterized in that said rotor is a hollow cylinder having a through hole passing through a peripheral wall thereof, and that a suction fan for sucking air from outside said nozzle into said rotor is attached to said rotor so that the sucked air by said sucking fan blows the surface to be cleaned through said through hole.

7. An electric vacuum cleaner as claimed in claim 6, wherein said electric vacuum cleaner is of upright type with said nozzle being arranged at a bottom of said body.

8. An electric vacuum cleaner comprising a body having an electric fan and a dust chamber, a nozzle having an opening at its bottom, a suction passage connecting an inside of said nozzle to said dust chamber, and a rotating brush including a rotor having bristles on a peripheral surface thereof and provided in said nozzle so as to rotate around an horizontal axis, and so operating that dust is sucked with air through the opening of said nozzle by an air flow produced by said electric fan through said suction passage, that sucked dust is collected in a dust bag housed in said dust chamber, and that a surface to be cleaned facing said opening is brushed by said rotating brush so as to promote separation of dust from the surface, characterized in that a reflux passage for guiding a slip stream of said electric fan to a vicinity of an end of said rotor is provided, and that an air passage for directing the guided slip stream of said electric fan to the peripheral surface of said rotor along said axis is provided at the end of said rotor so that the slip stream of said electric fan blows the surface to be cleaned through said air passage.

9. An electric vacuum cleaner as claimed in claim 8, wherein a pulley for receiving a rotation force is attached to the end of said rotor, a through hole is provided in said pulley as said air passage, and a fan is provided in said through hole for sending air to the peripheral surface of said rotor.

10. An electric vacuum cleaner as claimed in claim 8, wherein a fan for sending air to the peripheral surface of said rotor is attached to an end of said rotor opposite said air passage, and an air intake hole is provided to said nozzle at a position facing said fan.

11. An electric vacuum cleaner as claimed in claim 8, wherein a removable filter for capturing fine dust is provided in said reflux passage.

12. An electric vacuum cleaner as claimed in claim 8, wherein a part of said reflux passage between said body and said nozzle comprises a flexible hose, and an end of the hose is attachable to and detachable from said nozzle.

13. An electric vacuum cleaner as claimed in claim 8, wherein a part of said reflux passage within said nozzle is formed by partitioning the inside of said nozzle with a part of a nozzle case constituting said nozzle.

14. An electric vacuum cleaner as claimed in claim 8, wherein said electric vacuum cleaner is of upright type with said nozzle being arranged at a bottom of said body.

15. An electric vacuum cleaner as claimed in claim 8, wherein said rotor is a cylinder having a spiral ridge on a peripheral surface thereof, and said bristles are on said ridge.

* * * * *